US005709269A

United States Patent [19]

Head

[11] Patent Number: 5,709,269

[45] Date of Patent: Jan. 20, 1998

[54] DISSOLVABLE GRIP OR SEAL ARRANGEMENT

[76] Inventor: Philip Head, 6 Leith Mansions, Grantully Road, London W9 1LQ, Great Britain

[21] Appl. No.: 568,009

[22] Filed: Dec. 6, 1995

[30] Foreign Application Priority Data

Dec. 14, 1994 [GB] United Kingdom ..... 9425240

[51] Int. Cl.[6] ..... E21B 29/00

[52] U.S. Cl. ..... 166/376; 166/378; 166/120

[58] Field of Search ..... 166/376, 386, 166/120, 123, 317

[56] References Cited

U.S. PATENT DOCUMENTS 4,498,534 2/1985 Lindsey, Jr. .

4,699,641 10/1987 Knieriemen .

5,222,555 6/1993 Bridges .

FOREIGN PATENT DOCUMENTS 2 275 951 9/1994 United Kingdom .

WO 91/10806 7/1991 WIPO .

*Primary Examiner*—William P. Neuder

*Attorney, Agent, or Firm*—Herbert Dubno

[57] ABSTRACT

The invention relates to an releasable grip arrangement providing an impermeable barrier in an annular space between an inside tube and an outside tube of an oil well and is made of a material which may be dissolved by a suitable solvent and includes a seal member and a locking member 3, a sleeve which comprises holes which can be blocked during normal use but can be opened to permit the entrance of a solvent.

16 Claims, 7 Drawing Sheets

DISSOLVABLE GRIP OR SEAL ARRANGEMENT

FIELD OF THE INVENTION

The invention relates to a dissolvable grip or seal arrangement for packers, hangers, seals and coiled tubing connectors in oil and gas wells.

BACKGROUND OF THE INVENTION

Packers or hangers are probably the most common element utilized in a subterranean well after the installation of the casing. Packers and hangers primarily form a pressure seal between the production tubes and the last casing set and cemented in the well. They can be subjected to significant differential pressure and so require anchors to keep them fixed to the place they are required.

It has been conventional practice to use ratchet mechanisms to retain the packer or hanger in its engaged position, that is with the anchors, also known as slips, in the locked or "set" condition and the elastomer pressure seal in the sealing or "set" condition. Various methods can then be employed to deactivate the ratchet to retrieve the packer. They include rotating the assembly, over-pulling the assembly, releasing collets or machining it away. All these methods take up a lot of rig time and cause damage to the production tubes.

Furthermore with the advent of new wells being drilled into very hot formations conventional elastomer seals cannot endure long term exposure, deteriorate and can no longer form a pressure seal. Similarly, these wells can have extremely high pressure, which results in very high loads being exerted on the slip mechanisms.

Finally, there are new completions using coiled tubing. Until recently coiled tubing has mainly been used as work-over string for servicing oil and gas wells. Now, it has been employed in velocity strings, production strings and as spoolable gas lift strings.

It is envisaged that coiled tubing will become more widely used as the primary production path for future oil and gas wells. This is due to coiled tubing's improved quality, its ability for live work-over when the well is still producing and the economic savings.

However, coiled tubing has several limitations; namely, limited over-pull, ovality, connectablity, the size and weight of storage reels requiring field attachable connectors, and conventional connectors use only 'O' ring seals. Conventional connectors either require the coiled tubing to be deformed or require large torque to be applied to ensure the grapple system grips.

SUMMARY OF THE INVENTION

According to the invention a releasable grip arrangement is provided, for use in an oil or gas well, which is to provide a gripping engagement between a first tubular section and a second tubular section telescopically arranged with respect to the first tubular section; the dissolvable grip arrangement comprising a first grip part and a second grip part which when engaged together form the required gripping engagement between the first tubular section and the second tubular section, wherein at least part of at least one of the first and second grip parts is made of a material which may be dissolved by a suitable solvent.

According to the invention there is provided an annular seal arrangement to provide a impermeable barrier between the annular space such as between an inside tube and an outside tube of an oil well, such that a differential pressure can be maintained between one side of the releasable grip arrangement and the other in the longitudinal direction wherein the annular seal arrangement or a part of it is made of a material which may be dissolved by a suitable solvent.

The annular seal arrangement may include at least one seal member and at least one locking member. The seal member or the locking member may be made from a material which is dissolvable by a solvent. The entire grip arrangement may be made from a material which is dissolvable by a solvent such as magnesium.

The releasable grip arrangement may include a sleeve which comprises holes which permit the access of the solvent to the seal member or the grip parts to dissolve the seal member or grip part or a part thereof.

Preferably the holes are normally covered up during normal use to prevent fluids entering the grip arrangement but may be opened when it is required to break the seal to permit the entrance of the solvent. The holes may be opened by means of a sliding member. Alternatively the holes may be blocked by resilient caps which can be removed by a suitable mechanical levering action when the holes are required to be opened.

According to the invention the grip arrangement includes a release element which during the normal functioning of the seal ensures that the seal arrangement is locked against the inside and outside tubes and yet which when dissolved by the solvent permits the release of the grip arrangement. The release element may be made out of titanium.

According to the invention the seal arrangement also comprises a seal support member which may be made from a material which is dissolvable by a solvent.

Preferably the grip arrangement includes a release element which, during the normal functioning of the grip arrangement in the engaged condition, ensures that the grip arrangement is locked against the first and second tubular sections and which when dissolved by the solvent permits the release of the grip arrangement.

Conveniently the first tubular section of the releasable grip arrangement comprises axially extending slots extending from one end and a protuberance extending radially outwards from the one end for engaging with a correspondingly shaped radial groove in the second tubular section such that when the first and second tubes are engaged telescopically together the protuberance engages in the groove. A sleeve may be provided arranged concentrically with and internally of the end of said first tubular section and preventing internal radial deformation of the end and thus preventing the axial separation of the first and second tubular sections.

A sleeve may be arranged concentrically with and externally of the end of the first tubular section made of a material which is dissolvable such that when the solvent is applied it passes through the slots of the end of the first tubular section and permits the consequent release of the first and second tubular sections. Further grip parts or seal members may be provided externally of the second tubular section at least part of which are made of a material which is dissolvable by an appropriate solvent the solvent passing through the slots in the end of the first tubular means.

The sleeve is preferably made out of titanium.

Thus the invention permits easy disablement of the seal or packer which allows safe and easy removal of the coiled tubing from the well and avoids the other disadvantages of prior art systems referred to above.

Embodiments of the releasable grip and annular seal arrangements according to the invention will now be described in the form of packer, hanger and connector assemblies, by way of example only, with reference to the following figures.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
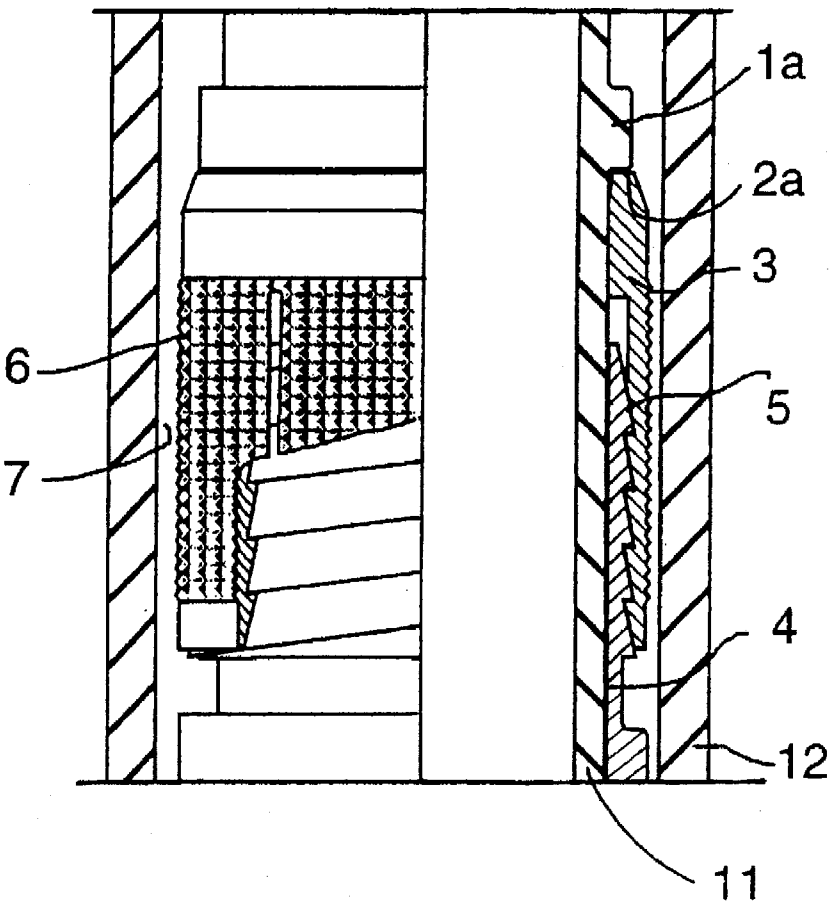
FIG. 1 is a longitudinal cross section of the locking members of the releasable grip arrangement of the invention not engaged.

Referring to FIG. 1*a* an releasable grip arrangement 1 is shown which is to provide an impermeable barrier in an annular space between an inside tube and an outside tube of an oil well, to maintain a differential pressure between one side of the releasable grip arrangement 1 and the other in the longitudinal direction. The releasable grip arrangement 1 or a part of it is made of a material which may be dissolved by a suitable solvent. FIG. 1 shows the locking members 3, 4 which may themselves be made of a material which can be dissolved by a solvent. The releasable grip arrangement 1 comprises a main mandrel 1*a* which is the entire length of the seal arrangement 1 on which a shoulder surface 2*a* is machined. The seal arrangement comprises locking parts 3 and 4 which are screwed together on a very coarse ramp type thread 5. This ramp thread 5 is the method employed to deploy and engage the gripping surface 6 of the locking part 3 against the internal casing surface 7. During the engaging process the mandrel 1*a* is subjected to a strong downward force, and the locking part 4 subjected to a strong upward force. As the locking part 3 is pressed against the shoulder 2*a* the wider parts 8 of the ramped thread 5 outwardly displaces the gripping surface 6. Slots 9 cut into the locking part 3 allow this outward movement to take place. The gripping surface 6 comprises a very course knurled surface 10, so that when it contacts the casing surface 7 a great many individual indentations are formed making an ideal anchor yet not scoring the casing surface and causing potential corrosion spots.

Another feature of this seal arrangement is that because the locking parts 3 and 4 are screwed together the seal arrangement 1 can be of any desired length without effecting the internal bore on to which it is to be arranged. This allows the gripping force to be distributed over a larger surface area and hence reduces the unit area loading. The engaging force is uniformly applied along the entire length of the seal arrangement, because of the course thread 5. The gripping mechanism 10 forms individual indents providing superior torque resistance than conventions slips or grapples. The indents do not score the surface they are gripping, and hence do not introduce stress risers or local corrosion points.

Figure 4:
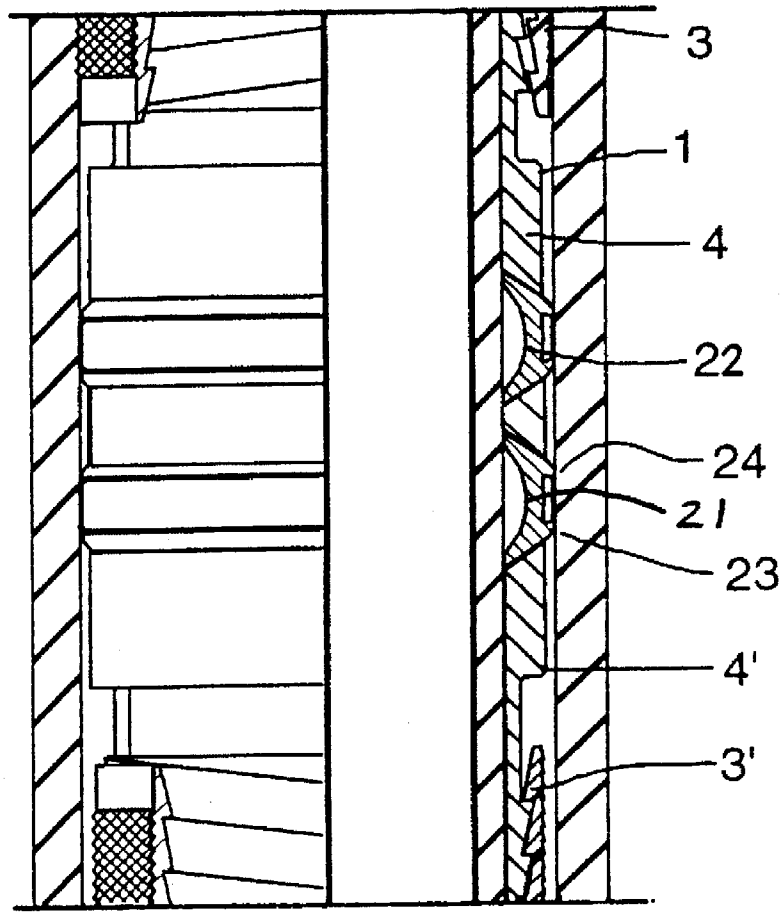
FIG. 4 is a longitudinal cross section of the seal members of the releasable grip arrangement of the invention in the engaged condition.
Figure 3:
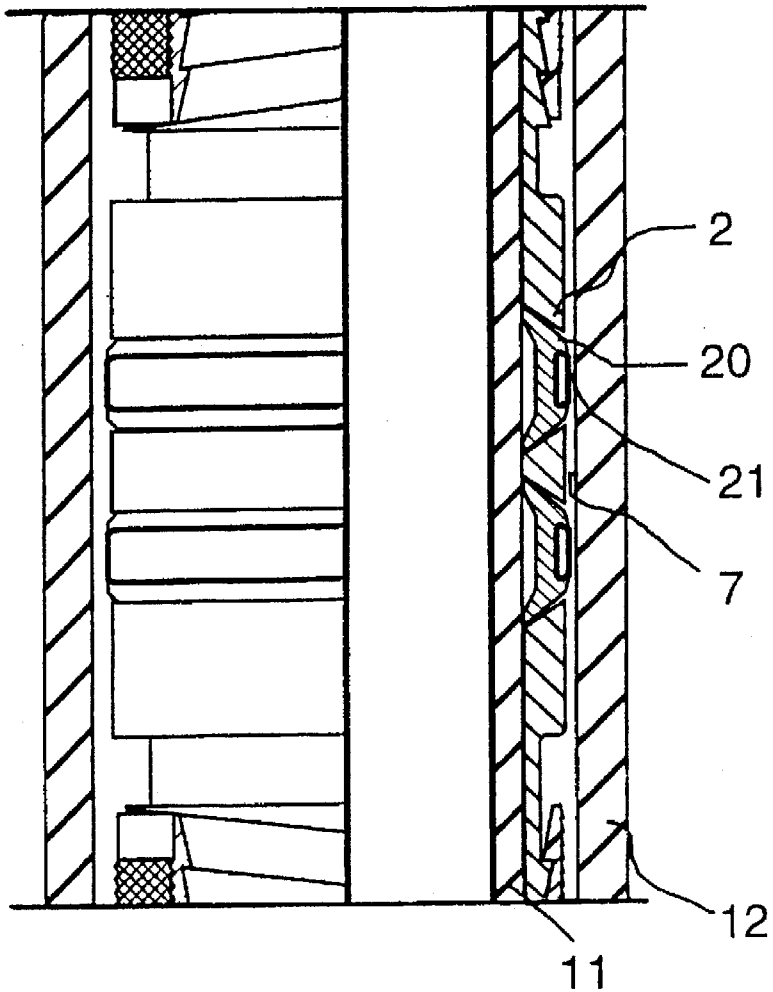
FIG. 3 is a longitudinal cross section of the seal members of the releasable grip arrangement of the invention not engaged.

Referring to FIGS. 3 and 4 the seal member 2 includes a seal support 20 and seal component 21. The seal support 20 may be made from a material which is dissolvable by a solvent.

Figure 2:
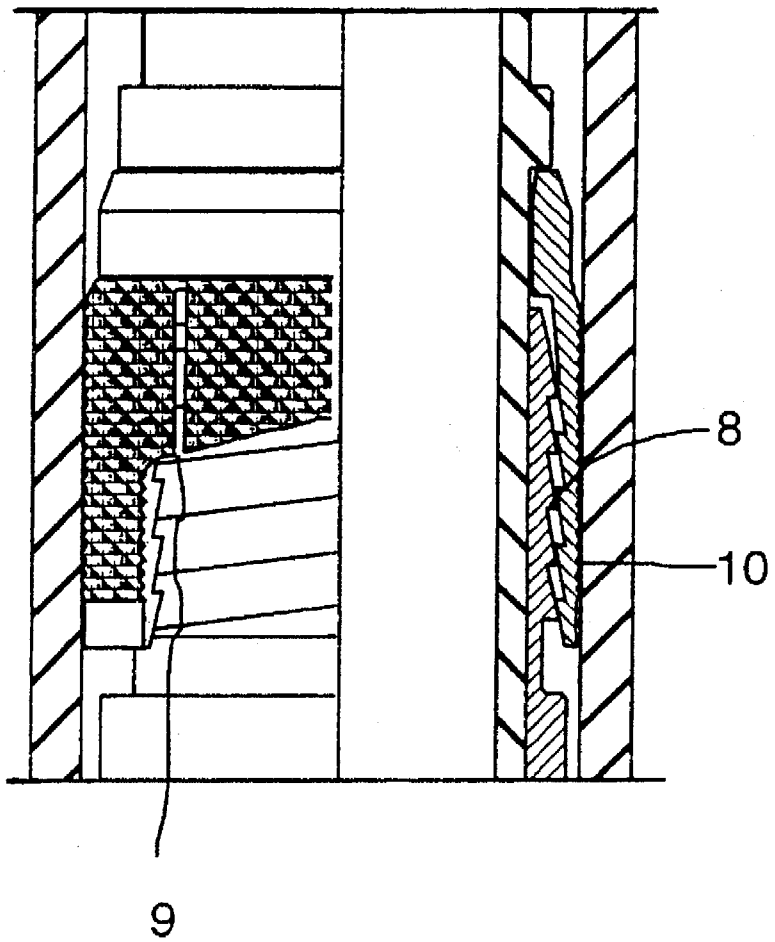
FIG. 2 is a longitudinal cross section of the locking members of the releasable grip arrangement of the invention in the engaged condition.

Referring to FIGS. 3 and 4 the metal-to-metal seal assembly will now be more fully described. The mandrel as described in FIG. 1 and 2 passes through this part of the assembly and is indicated. FIG. 4 shows the upper locking members 3 and 4 engaged and lower locking members 3' and 4' not engaged, held in this position by shear pins not shown. Further downward force causes the shearing of these shear pins and the lower locking members are also forced into the engaged position thus securing the whole releasable grip arrangement in the engaged condition.

The metal-to-metal seal member 21 itself may utilize a composite construction consisting of a soft malleable alloy, dissolvable such as magnesium, which forms the pressure seal to the surface 7 against which it is being forced. This may be backed-up by a strong alloy seal support 20 having a high modulus of elasticity.

In operation, when the high strength alloy seal support 20 is deformed 22, it contacts the casing surface at two contact points 23, 24 either side of the softer alloy seal member 21. At the same time the softer alloy is pressed against the casing and conforms to the casing surface forming a metal-to-metal pressure seal. When subjected to differential pressure the high strength alloy seal support 20 operates as an ideal back-up preventing the softer alloy seal member 21 being extruded between it and the casing surface.

The materials chosen for the seal support 20 are preferably very strong 20, such as titanium, yet can be removed by selective chemical solvents. Titanium has no resistance to hydrofluoric acid, so this may be circulated past the releasable grip arrangement and other components to allow the easy removal of the assembly, alleviating the difficulties of removing an interference fit metal-to-metal seal.

Figure 5:
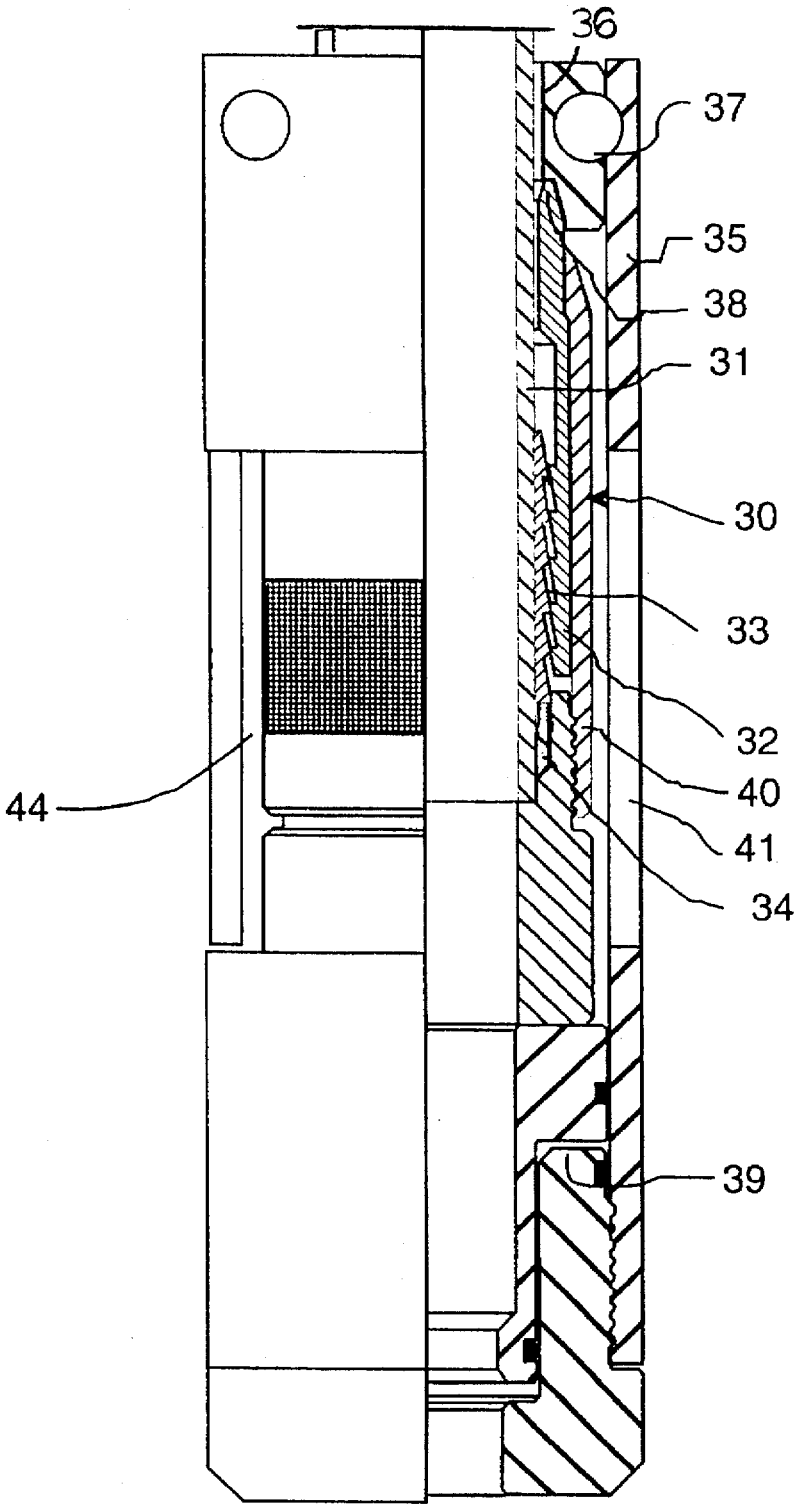
FIG. 5 is a longitudinal cross section of the hydraulic assembly tool used to engage the releasable grip arrangement of the invention.

Referring to FIG. 5, this shows a longitudinal section through the tool which is used to hydraulically engage an releasable grip arrangement according to the invention as a coiled tubing connector 30. The coiled tubing connector 30 grips on the external surface of the coiled tubing 31 using locking members 32, 33 as described above. The coiled tubing connector also includes seal member 34.

Both the seal member 34 and locking members 32, 33 will be put together using an hydraulic assembly system. This consists of a sleeve 35 which can slide over the external surface of the connector 30. A split sleeve 36 is arranged against the upper surface of the connector 30 by means of support shoulder 38 and connected to the sleeve 35 via two pins 37. This now allows the assembly to be hydraulically pulled together when hydraulic pressure is applied to the chamber 39. Once engaged the outer sleeve of the connector 30 is tight to the threads 40 via access to it by the window 41 of the sleeve 35. This ensures a known force is applied to the metal-to-metal seal 34 ensuring that it conforms to the surface of the coiled tubing 31 with which it is sealing. Similarly, the locking members 32, 33 will be accurately loaded to a known gripping force which can be engineered to be within the limits of the material it is attached to while being able to withstand the forces acting on it when it is in the well.

This hydraulic energizing system also operates on the running tools which will deploy the hangers and packers.

Figure 6:
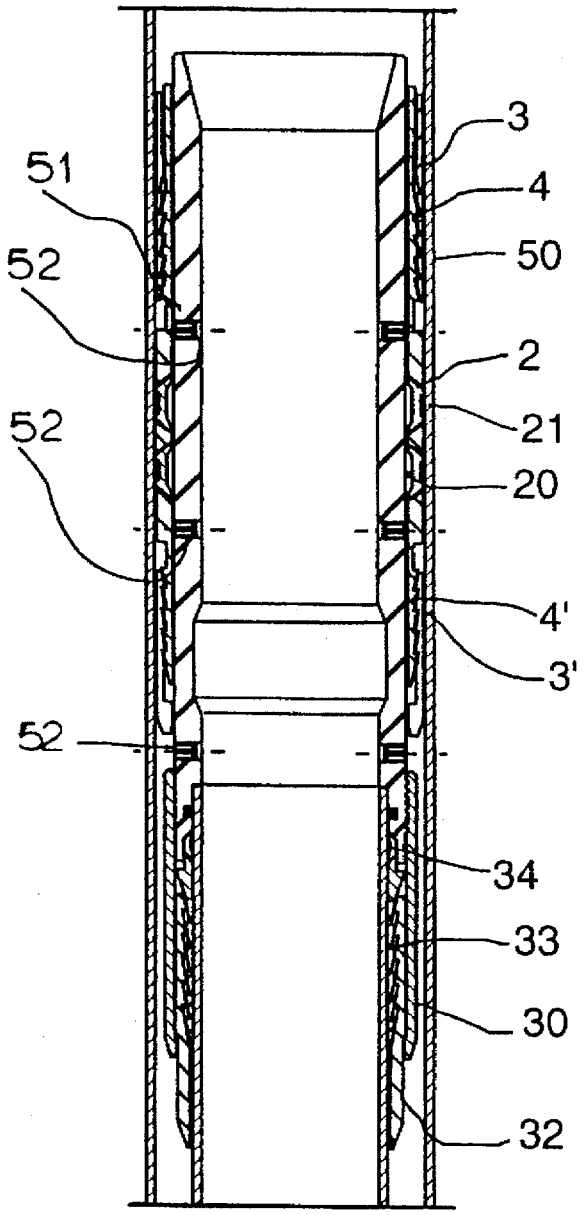
FIG. 6 is a longitudinal section of an releasable grip arrangement according to the invention used as a tubing hanger engaged in a larger tubing or casing.

Referring to FIG. 6 the releasable grip arrangement 1 includes a sleeve 4 which comprises holes 51 which permit the access of the solvent to the seal member 2 or the locking member 3 to dissolve the seal member 2 or locking member 3 or a part thereof. The holes 51 are blocked during normal use of the seal arrangement 1 and may be opened when it is required to break the seal to permit the entrance of the solvent. The holes 51 may be blocked and opened by means of a sliding member. Alternatively the holes 51 may be blocked by resilient caps which can be removed by a suitable mechanical levering action when the holes are required to be opened. In the embodiment in FIG. 6 the holes 51 are blocked by plugs 52 which may be pushed through when the holes are required to be opened or dissolved.

Figure 7:
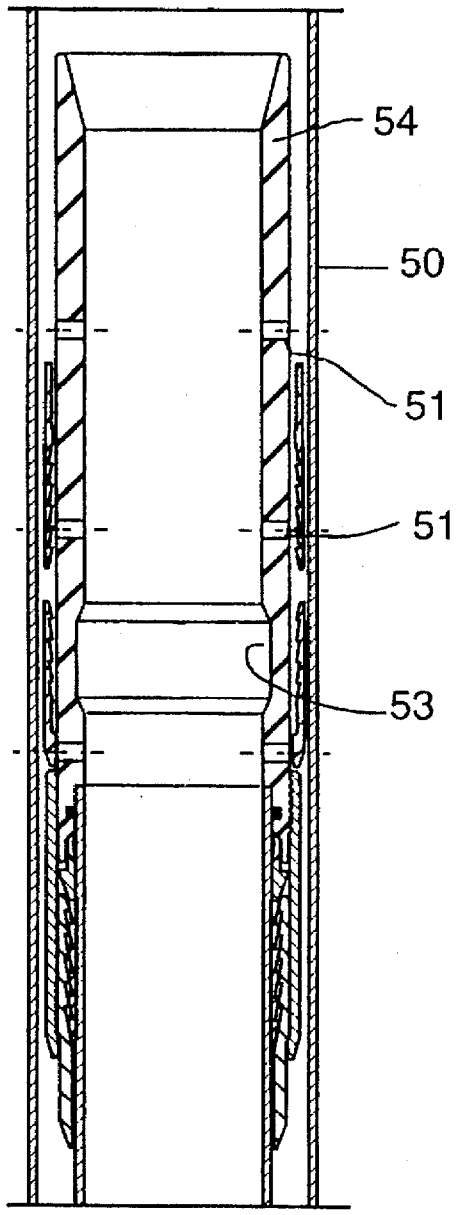
FIG. 7 is a similar view to FIG. 6 of the releasable grip arrangement after the application of a solvent.

FIG. 7 shows the seal arrangement after the solvent has been applied. The components which were made from dissolvable materials, in this case the seal members 2 and the locking members 4, 4', have been dissolved breaking the seal and permitting the removal or further work on the hanging tubing 51.

A retrieval tool, not, shown, would locate in the profile 53 of the hangers main body 54. Hydrofluoric acid would be circulated past the plugs 52, which are metal-to-metal sealing plugs made from a suitably soluble material such as Titanium. Once the hydrofluoric acid is able to access the exterior surface of the hanger body 54 all the other items dissolvable in hydrofluoric acid will disappear allowing the safe and easy removal of the packer, hanger or connector.

Figure 8:
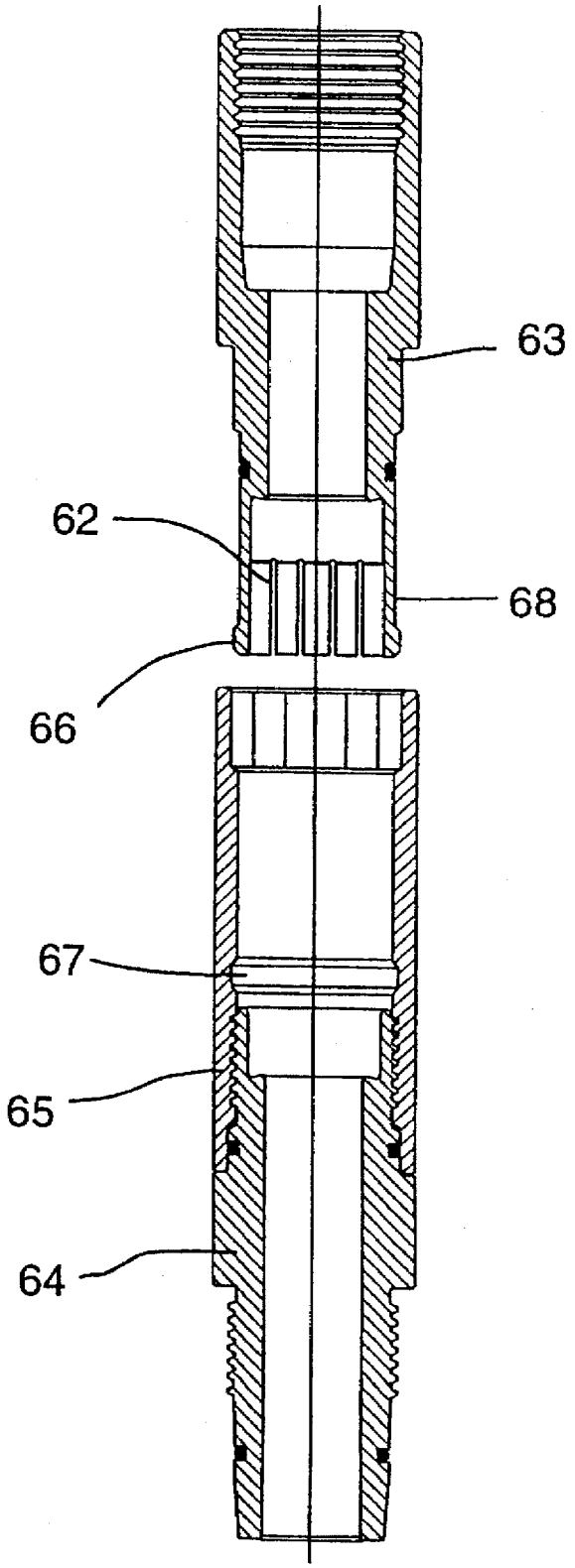
FIG. 8 is a longitudinal section of a grip arrangement according to the invention for a connector.
Figure 9:
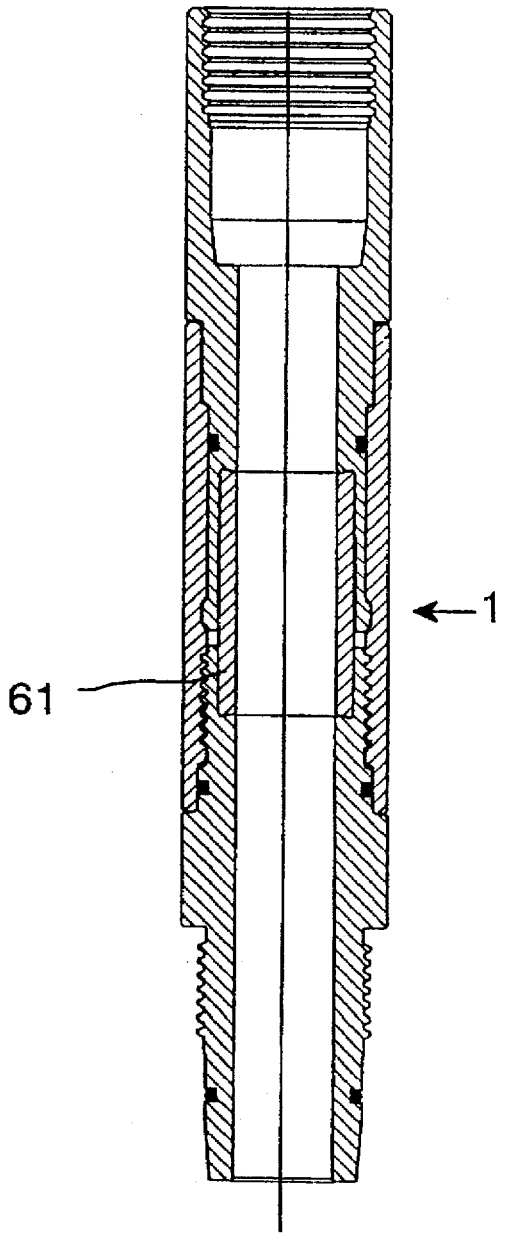
FIG. 9 is the view of FIG. 8 with the connector in the connected position.

Referring to FIGS. 8 and 9 the grip arrangement 1 for a connector includes a release element 61 which during the normal functioning of the grip arrangement 1 ensures that the it is locked gripping the two tubes 63, 64 together. The release element 61 is made of a dissolvable material such as titanium and which when the appropriate solvent such as hydrofluoric acid is applied it dissolves and permits the release of the grip arrangement 1. Titanium provides the required strength as well as being selectively dissolved when required by an appropriate solvent.

In the grip arrangement shown in FIGS. 8 and 9 the tubular section 63 comprises axially extending slots 62 arranged radially and extending from one end and a protuberance 66 extending radially outwards from said end for engaging with a correspondingly shaped radial 67 groove in the second tubular section 64 such that when the tubes 63, 64 are engaged telescopically together the protuberance 66 engages in the groove 67. The slots permit the inward deformation of the end which permits the protuberance 66 to be disengaged from the groove 67.

The release element is a sleeve 61 is provided arranged concentrically with and internally of the end of the tubular section 63 and preventing internal radial deformation of the end 68 and thus preventing the axial separation of the tubular sections 63, 64. When the solvent is applied the sleeve 61 is dissolved permitting the inward radial deformation of the end 68 of the tubular section 63 and the consequent release of the tubular sections 63, 64.

Figure 10:
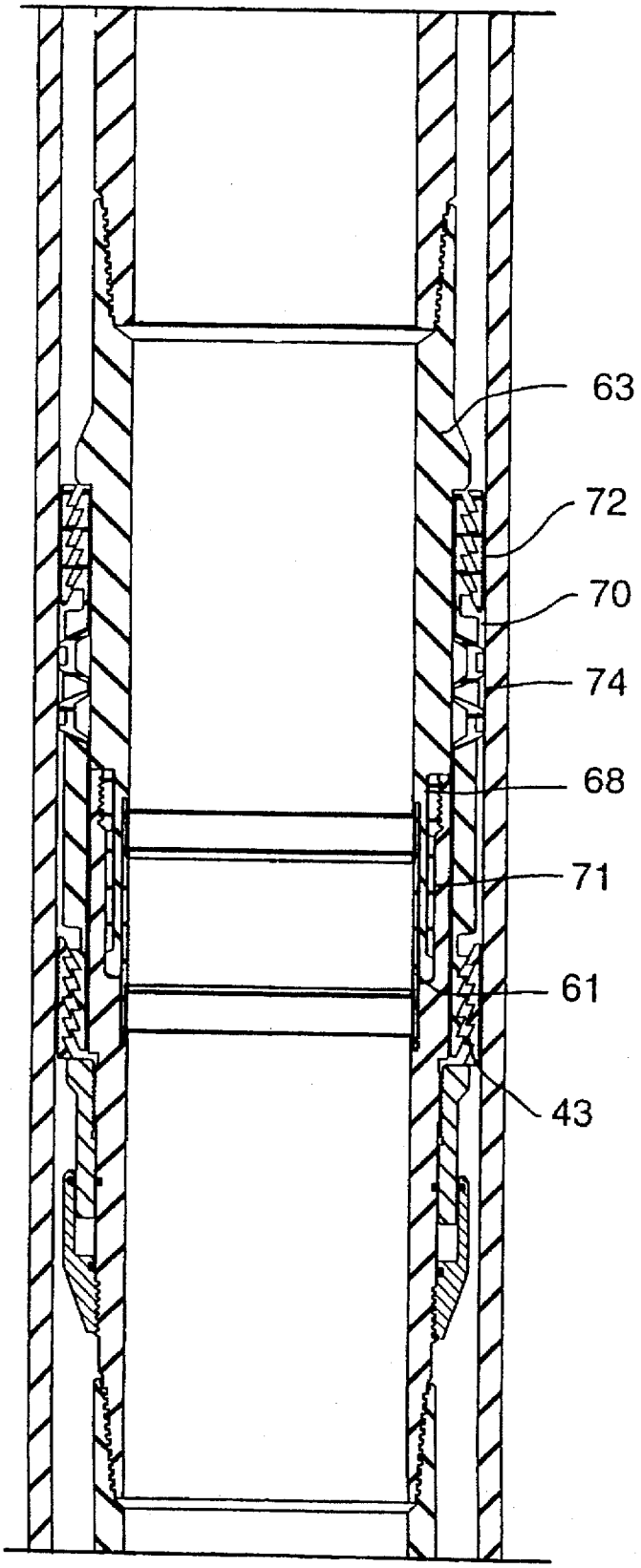
FIG. 10 is a longitudinal section of a grip arrangement according to the invention for a connector and seal arrangement.
Figure 11:
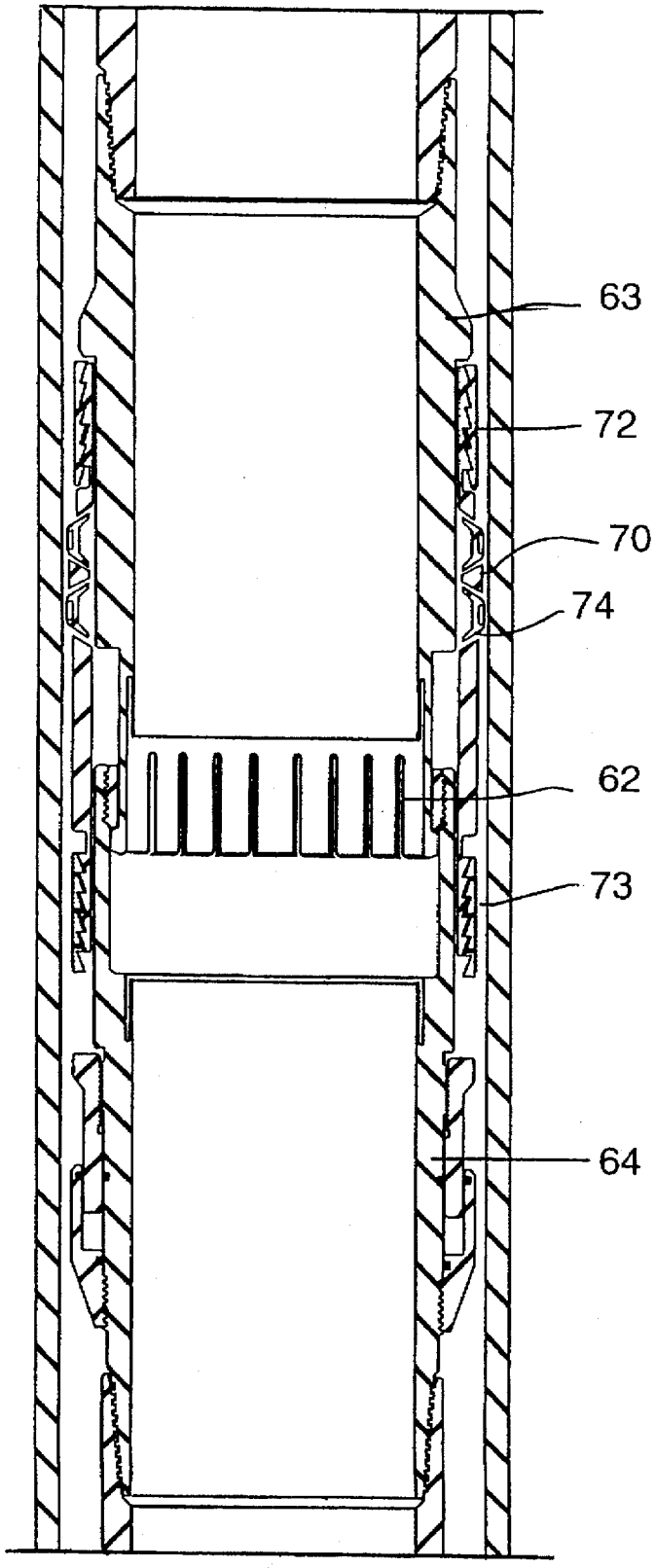
FIG. 11 is the view of FIG. 9 in the disengaged position.

Referring to FIGS. 10 and 11 a grip arrangement is shown which acts as a connector between the tubular sections 63, 64 and which is also arranged concentrically with a second grip arrangement for a seal, or a packer 70. A sleeve 71 is provided arranged concentrically with and externally of the end 68 of the tubular section 63 (FIG. 10) and is made of a material which is dissolvable with an appropriate solvent. When the solvent is applied it passes through the slots 62 of the end 68 of the first tubular section 63 and permits the consequent release of the first and second tubular sections 63, 64. The solvent can then continue to pass through the slots and in between the two released ends of the tubular sections 63, 64 to the second grip arrangement 70. This second grip arrangement 70 comprises further grip parts 72, 73 or seal members 74 at least part of which are made of a material which is dissolvable by the solvent said solvent to release this seal or packer.

I claim:

1. A releasable gripper assembly comprising:

first and second tubular sections centered along an axis and coaxial with one another;

first and second locking members coaxial with the tubular sections; and engaging means for engaging and for axially displacing the locking members with respect to one another, at least one of the first and second locking members being made of a dissolvable material and adapted to expand radially in a locking position during axial displacement of the locking members to operatively engage at least one of the tubular sections.

2. The gripper assembly defined in claim 1 wherein said first and second tubular sections are telescopically displaceable with respect to each other to form an annular space therebetween, said locking members being mounted in said annular space, said one of the locking members comprising seal means for engaging a surface of a respective tubular section facing the sealing means upon radial expansion of the one locking member, so that the annular space is sealed.

3. The gripper assembly defined in claim 2 wherein said seal means includes an annular seal providing an impermeable barrier in the annular space.

4. The gripper assembly defined in claim 1 wherein said engaging means includes a co-operating ramped threads.

5. The gripper assembly defined in claim 1 wherein both said first and second locking members are made of the dissolvable material.

6. The gripper assembly defined in claim 2 wherein said seal means further comprises a seal support made of the dissolvable material.

7. The gripper assembly defined in claim 1 further comprising an annular release element extending coaxially between said locking elements and the tubular sections, said release element being made of the dissolvable material and being pressed between the locking elements and the tubular elements in the locking position of the one locking element, the locking elements being released from engaging the tubular elements upon dissolving of the release element.

8. The gripper assembly defined in claim 1 wherein one of the tubular sections is formed with at least one axial slot extending from one end of the one tubular section and with an axial formation extending radially outwardly from the other end of the one tubular section, the other tubular section being provided with a radial groove receiving the formation upon axial displacement of the tubular sections with respect to one another.

9. The gripper assembly defined in claim 8 further comprising at least one sleeve coaxial with said tubular sections and mounted between said locking elements and the one end of the one tubular section to prevent internal radial deformation of the one end, said sleeve being provided with at least one passage leading to said one locking element.

10. The gripper assembly defined in claim 9 wherein said sleeve is made of the dissolvable material, so that said tubular sections are axially displaceable upon dissolving of the sleeve.

11. The gripper assembly defined in claim 10 wherein said sleeve further comprises cap means for controllably closing said passage.

12. The gripper assembly defined in claim 11 wherein said cap means includes at least one resilient cap.

13. The gripper assembly defined in claim 11 wherein said cap means includes at least one displaceable plug.

14. The gripper assembly defined in claim 8 further comprising another sleeve mounted between the other tubular section and the locking elements, said other sleeve being provided with a respective passage leading to the locking elements.

15. The gripper assembly defined in claim 1 wherein said dissolvable material is selected from a group consisting of magnesium and titanium.

16. A method of detachably supporting an inner tubular member in an outer tubular member of an oil or gas well which comprises the steps of:

a) affixing said inner tubular member to an inner wall of said outer tubular member by expanding a first grip part with a second grip part, at least one of said grip parts being composed of a material soluble in a solvent; and b) releasing the engagement of said grip parts by passing said solvent into contact with said grip parts, thereby dissolving the grip part made of said material.

* * * * *